United States Patent [19]

Nakamura et al.

[11] Patent Number: 4,744,773

[45] Date of Patent: May 17, 1988

[54] MULTI-LAYER FLAT CABLE ELECTRICAL CONNECTOR AND ITS TERMINATION METHOD

[75] Inventors: Mitsuo Nakamura; Keiji Souma, both of Tokyo, Japan

[73] Assignee: Hirose Electric Co., Ltd., Tokyo, Japan

[21] Appl. No.: 75,740

[22] Filed: Jul. 20, 1987

[30] Foreign Application Priority Data

Aug. 8, 1986 [JP] Japan ..... 61-186240

[51] Int. Cl.[4] ..... H01R 4/24

[52] U.S. Cl. ..... 439/418

[58] Field of Search ..... 439/391, 392, 395, 396, 439/406, 407, 417, 418

[56] References Cited

U.S. PATENT DOCUMENTS

| | | | |
|---|---|---|---|
| 3,702,982 | 11/1972 | Kelly et al. | 439/418 |
| 4,025,141 | 5/1977 | Thelissen | 439/418 |
| 4,195,893 | 4/1980 | Stupay | 339/14 R |
| 4,278,314 | 7/1981 | Moser et al. | 339/99 R |
| 4,406,512 | 9/1983 | Schell | 339/177 R |
| 4,451,099 | 5/1984 | Bricker, Jr. et al. | 339/14 R |

*Primary Examiner*—Joseph H. McGlynn

*Attorney, Agent, or Firm*—Yusuke Takeuchi

[57] ABSTRACT

A multi-layer flat cable electrical connector for terminating flat cables in a plurality of layers, which comprises a plurality of contacts having a contacting portion for contact with a contact of the mating connector and a press-fit portion for connection with a conductor of said flat cable; an insulating housing for supporting said contacts so that said press-fit portions may project upward from its top surface in at least a pair of rows; a cable retainer with a retention channel for holding the end portions of said flat cables laminated one upon another, a plurality of termination grooves for receiving each conductor of said flat cable on either side, and a plurality of recesses for receiving said press-fit portions projecting from said housing, said cable retainer adapted to join to said insulating housing to complete said multi-layer flat cable electrical connector.

7 Claims, 4 Drawing Sheets

MULTI-LAYER FLAT CABLE ELECTRICAL CONNECTOR AND ITS TERMINATION METHOD

BACKGROUND OF THE INVENTION

1. Field of the Invention

The present invention relates to a multi-layer flat cable electrical connector for terminating flat cables in a pluraliry of layers and its termination method.

2. Description of the Prior Art

As electronic equipment has been made more compact and light-weight, and the density with which the conductors of a flat cable are arranged bocomes higher, there is a growing demand for a more compact electrical connector with many contacts arranged in high density to terminate such a high density flat cable. The inventors have already proposed an electrical connector for terminating a plurality of layers of flat cables each having a large number of conductors disposed side by side at a pitch of 1.27 mm (see Japanese Patent Kokai No. 60-167285).

Although the above multi-layer flat cable electrical connector has satisfied a high density mounting requirement it suffers from the following shortcomings.

(1) It has no means for securing attachment of a plurality of layers of flat cables to the insulating housing with many contacts so that an accidental pull applied to the cables is transmitted directly to the contacts, making the connection between the cables and the contacts unstable, causing noise or even breaking a conductor of the cables.

(2) A plurality of flat cables are terminated to a connector with a space between the adjacent cables so that the connector occupies a large space in the equipment and is difficult to plug in or out.

(3) It is necessary to terminate a plurlity of flat calbes to the correspondidng row of contacts layer by layer and it is impossible to terminate all flat cables at once, thus requiring a complex termination operation and increasing the unit manufacturing cost.

SUMMARY OF THE INVENTION

According to one aspect of the invention there is provided a multi-layer flat cable electrical connector for terminating flat cables in a plurality of layers, which comprises a plurality of contacts having a contacting portion for contact with a contact of the mating connector and a press-fit portion for connection with a conductor of said flat cable; an insulating housing for supporting said contacts so that said press-fit portions may project upward from its top surface in at least a pair of rows; a cable retainer with a retention channel for holding the end portions of said flat cables laminated one upon another, a plurality of termination grooves for receiving each conductor of said flat cable on either side, and a pluraliry of recesses for receiving said press-fit protions projecting from said housing, said calbe retainer adapted to join to said insulating housoing to complete said multi-layer flat cable electrical connector.

According to another aspect of the invention there is provided amethod of terminating flat cables in a plurality of layers to a multi-layer flat cable electrical connector of the type described above which comprises the steps of placing the end portions of said flat cables one upon another in said retention channel; separately holding said end portions to opposite sides in said conrresponding termination grooves of said termination members; joining said insulating housing with said plurality of contacts to said termination members with said end portions kept on said termination grooves thereby press-fitting said respective end portions to said corresponding press-fit portions.

Other objects, features, and advantages of the invention will be apparent from the following description taken in conjuction with the accompanying drawings.

DESCRIPTION OF THE PREFERRED EMBODIMENTS

Figure 1:
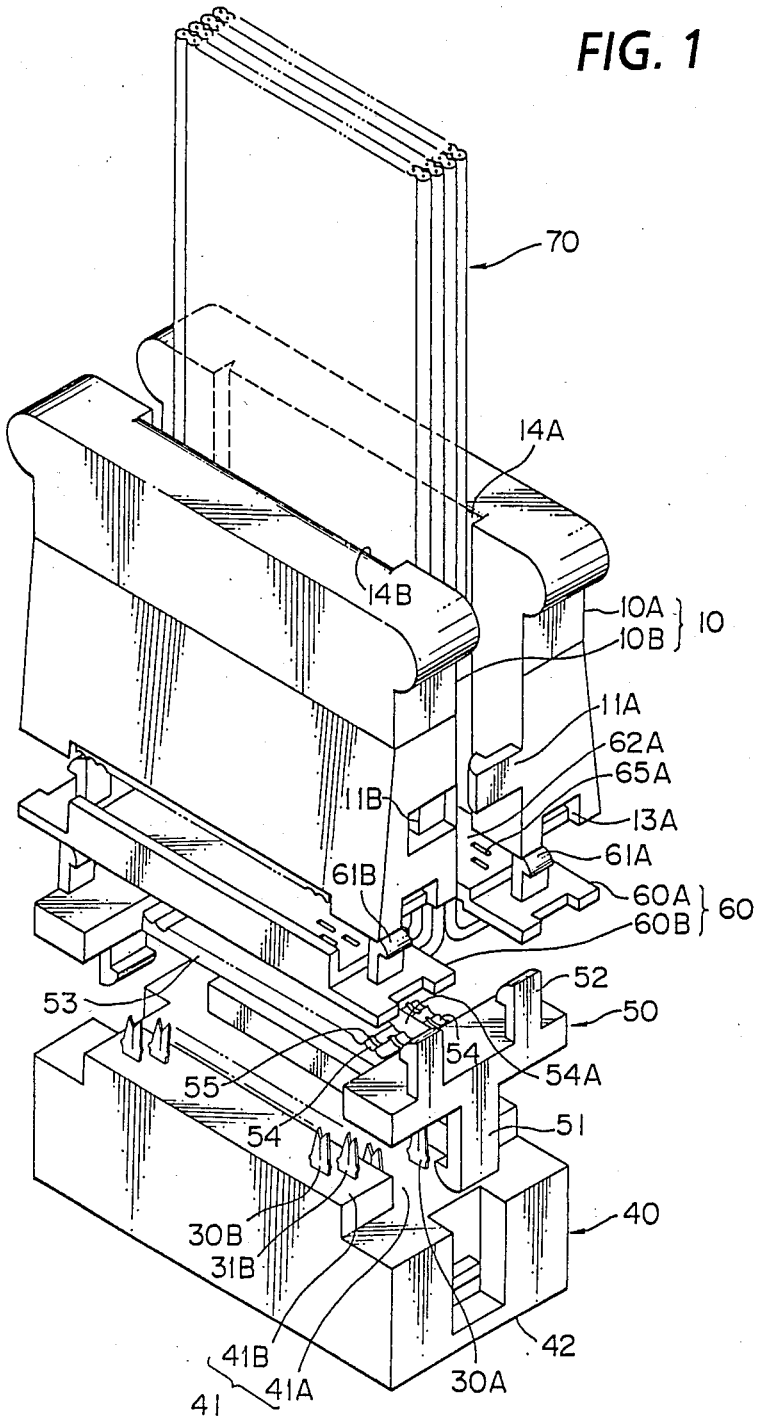
FIG. 1 is an exploded perspective view of a multi-layer flat cable embodying the present invention.

Referring now to FIG. 1 there is shown a multi-layer flat cable electrical connector embodying the present invention, which consists of a calbe retainer 10 for retaining a multi-layer flat cable 70, a plurality of contacts 30, each having a contacting portion (not shown) for contact with a contact of the mating connector and a press-fit portion 31 for connection with a conductor of the flat cable, an insulating housing 40 for supporting the contacts 30 in such a manner that the press-fit portions 31 may project upward from its top, a first termination member 50 disposed on top of the insulating housing 40, to which an inner pair of flat cables 70A are terminated, and a second termination member 60 disposed on top of the first termination member 50, to which an outer pair of flat cables 70B are terminated.

Figure 2:
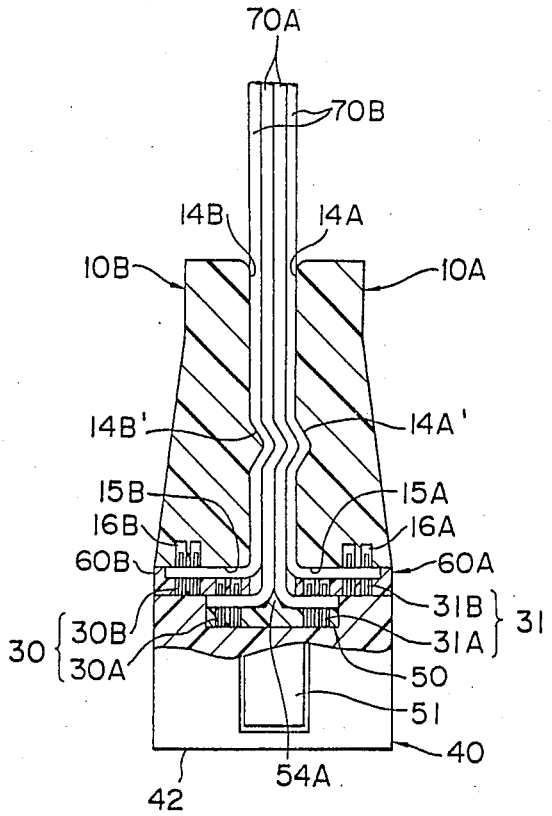
FIG. 2 is a sectional view of the electrical connector of FIG. 1.

As FIG. 2 shows, the cable retainer 10 is composed of a right retainer section 10A and a left retainer section 10B. The right and left retainer sections 10A and 10B are made to join each other. The right retainer section 10A has a latching arm 11A to engage a latch recess 11B of the left retainer section 10B thereby uniting these two sections. It also has on the lower side a latch recess 13A for receiving a latching arm 52 extending upward from the first termination member 50 and on the bottom a latch aperture (not shown) for receiveing a latching arm 61A extending upward from a right termination section 60A. The left retainer section 10B is similar to the right retainer section 10A and its description will be omitted.

The right retainer section 10A further has a retention channel 14A for cooperation with a retention channel 14B of the left retainer section 10B to retain the flat cables 70A and 70B in four layers in this embodiment. The retention channel 14A has a V-shaped groove 14A' for cooperation with a V-shaped ridge 14B' of the retention channel 14B to prevent pulling off of the multi-layer flat cable 70. The right retainer section 10A has on the bottom a termination channel 15A on which a pair of rows of recesses 16A are disposed in a zigzag fashion to receive the press-fit portions 31B.

The contacts 30 to be held by the insulating housing 40 are made of spring conductive metal and each have a contacting portion (not shown) and a press-fit portion 31. Contacts 30A are shorter than contacts 30B.

The insulating housing 40 is made of a plastic or other dielectric material and has a top 41 and a bottom 42. The top has a first surface 41A and a pair of second surfaces 41B on opposite sides. The second surfaces 41B are raised from the first surface 41A. Two pairs of rows of press-fit portions 31A of shorter contacts 30A project from the first surface 41A in a zigzag fashion, and a pair of rows of press-fit portions 31B of longer contacts 30B project from each of the second surfaces 41B. On the bottom or front 42 there is provided an opening (not shown) for receiving the contacts of a mating connector for contact with the respective contacts 30A and 30B.

The first termination member 50 is made of a plastic or other dielectric material and has on either side a downward latching arm 51 and a pair of upward latching arms 52. Between opposite broadened edges 56 on the top there is provided a termination surface 53 with a number of termination grooves 54 disposed parallel to the broadened edges 56 for receiving the conductors of an inner pair of flat cables 70A which are bent at right angles in opposite directions. Along the longitudinal axis of the termination surface 53 there is provided a ridge 54A for separating the inner pair of flat cables 70A into a single flat cable on each side. A pair of rows of slots 55 are provided in a zigzag fashion on either side of the ridge 54A for receiving the press-fit portions 31A projecting from the first top surface 41A.

The second termination member 60 consists of a pair of termination sections 60A and 60B corresponding to the pair of retainer sections 10A and 10B. The right termination section 60A has a pair of upward latching arms 61A on opposite ends and a termination surface 62A on which a pair of rows of slots 65A are disposed in a zigzag fashion for receiving the press-fit portions 31A. It is preferred that the termination surface 62A are constructed so that it may fit into the termination channel 15A provided on the bottom of the right retainer section 10A. The left termination section 60B is similar to the right termination section 60A and its detailed description will be omitted.

Referring to FIGS. 3 through 6 there is shown a method of terminating a multi-layer flat cable to an electrical connector such as shown above.

(1) First of all, the end portion of a multi-layer flat cable 70 is arcuated by means of an appropriate tool. If the flat cable is soft, this operation may be omitted.

Figure 3:
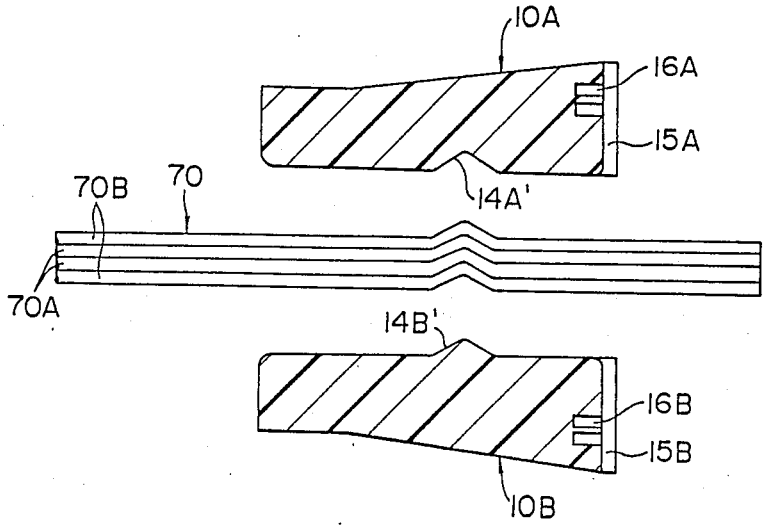
FIGS. 3 through 6 are sectional views for illustrating a method of terminating a multi-layer flat cable to the electrical connector of FIG. 1.

(2) Next, as FIG. 3 shows, the flat cable is placed between the right or upper and left or lower retainer sections 10A and 10B, which are then joined together so that the arcuated section of the flat cable 70 is firmly held between the groove 14A' of the right retainer section 10A and the ridge 14B' of the left retainer section 10B. The length of the flat cable 70 projecting from the bottom of the cable retainer 10A and 10B should be sufficient to facilitate separation of the flat cables 70A and 70B toward both sides.

Figure 4:
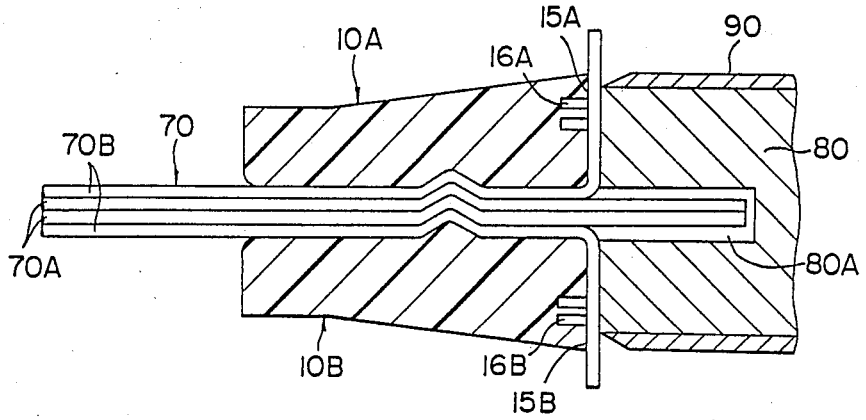

(3) As FIG. 4 shows, the outer pair of flat cables 70B is separated to either side and pressed against the termination grooves 15A and 15B provided on the right and left retainer sections 10A and 10B by means of a metal die 80. The excess portions of the cables 70B are cut off by a pair of cutters 90 provided on opposite sides of the metal die 80. The metal die 80 has a recess 80A for receiving the inner pair of flat cables 70A.

Figure 5:
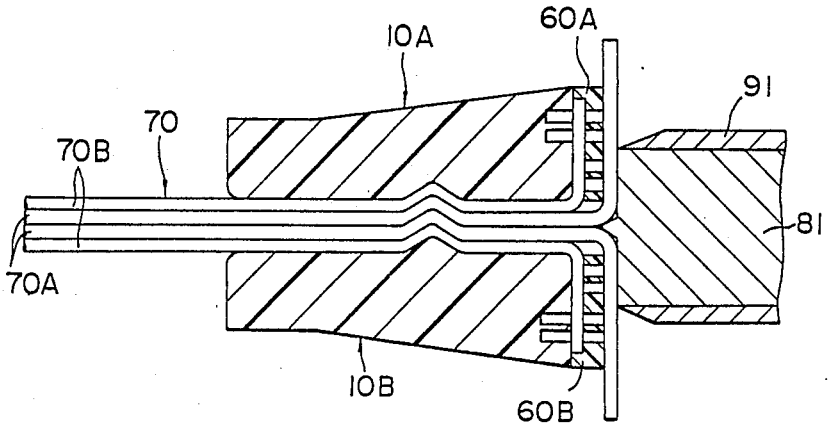

(4) As FIG. 5 shows, the right and left termination sections 60A and 60B are joined to the right and left retainer sections 10A and 10B, respectively, to secure the end portionss of the outer flat cables.

(5) Then, the inner pair 70A is separated to opposite sides and pressed against the termination sections 60A and 60B by means of a metal die 81. The excess portions of the cables 70A are cut off by a pair of cutters 91 provided on opposite sides of the metal die 81.

Figure 6:
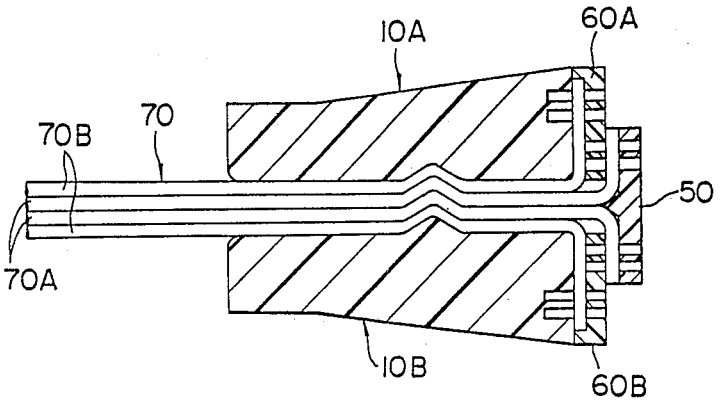

(6) As FIG. 6 shows, the first termination member 50 is joined to the right and left termination sections 60A and 60B to secure the end portions of the inner pair of flat cables 70A.

(7) Finally, the cable retainer 10 with the multi-layered flat cable 70 mounted is joined to the insulating housing 40 with a number of contacts 30 so as to press fit the respective conductors of the flat cables 70 into the corresponding press-fit portions 31 of the contacts 30 (FIG. 2).

Figure 7:
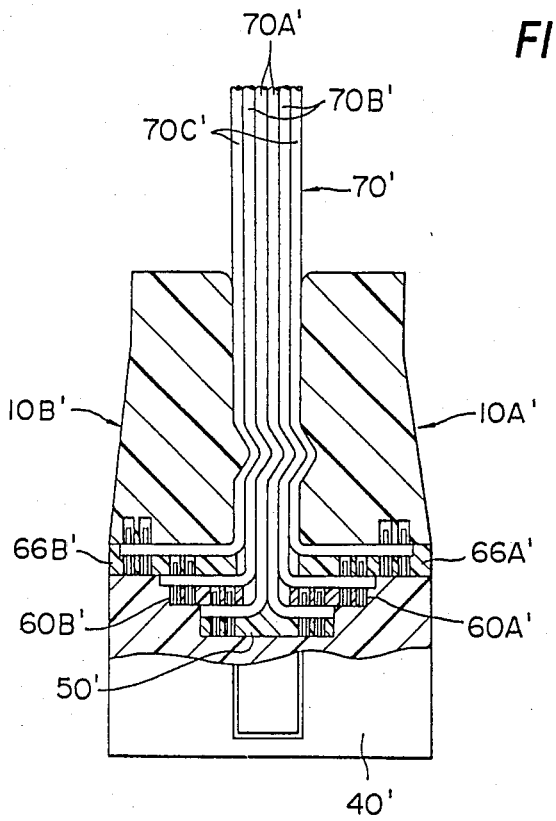
FIG. 7 is a sectional view of another multi-layer flat cable electrical connector embodying the present invention.

FIG. 7 illustrates another multi-layer flat cable electrical connector according to the invention. This electrical connector is useful for terminating a multi-layer or six-layer flat cable in three different levels in contrast to the two levels in the above embodiment. A six-layer flat cable 70' has an inner pair 70A', an intermediate pair 70B', and an outer pair 70C' of flat cables. Consequently, a pair of third termination sections 66A' and 66B' are provided to secure the end portions of the outer pair of flat cables 70C' to the retainer sections 10A' and 10B' as well as the first and second termination members 50A, and 60A' and 60B'. The insulating housing 40' has a top surface adapted to receive these termination members. The other structures are similar to those of the above embodiment, and their description will be omitted.

Figure 8:
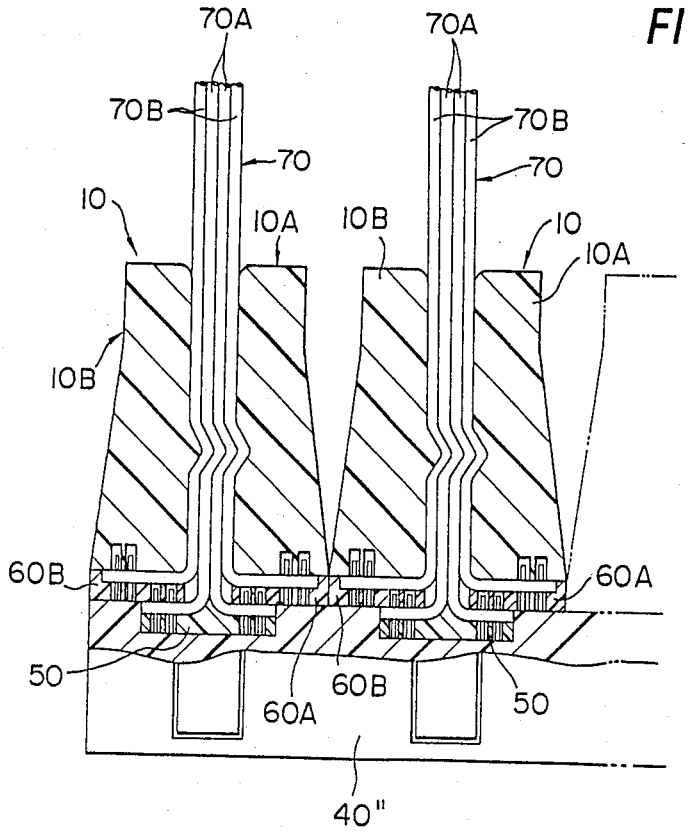
FIG. 8 is a sectional view of still another multi-layer flat cable electrical connector embodying the present invention.

FIG. 8 illustrates still another multi-layer flat calbe electrical connector embodying the present invention. In this embodiment, an insulating housing 40'' is able to receive, side by side, a plurality of electrical connectors such as shown in FIG. 2. The other features are similar to those of FIG. 2, and their description will be omitted.

[Advantages of the Invention]

According to the invention there are provided the following advantages.

(1) Since the cable retainer firmly hold a multi-layer flat cable, any accidental force applied to the cable is not transmitted directly to the connection between the cable conductors and the contacts, thus eliminating the possibility of poor connection or disconnection.

(2) Since the respectivel flat cables are laminated one upon another with no space between them, the electrical connector is made more compact, thus making it possible to mount them on electronic equipment in higher density than before. In addition, the laminated structure eases the plug in or out operation.

(3) Since a large number of multi-layered flat cables are able to attach to cable retainers before the press-fit operation, an automatic wiring operation in volume is possible, thus reducing the unit manufacturing cost to a large extent.

While a preferred embodiment of the invention has been described above, such description is illustrative purpose only, and it is to be understood that changes and variations may be made without departing the spirit and scope of the invention as recited in the following claims.

What is claimed is:

1. A multi-layer flat cable electrical connector for terminating flat cables in a plurality of layers, which comprises:

a plurality of contacts having a contacting portion for contact with a contact of the mating connector and a press-fit portion for connection with a conductor of said flat cable;

an insulating housing for supporting said contacts so that said press-fit portions may project upward from its top surface in at least a pair of rows;

a cable retainer with a retention channel for holding the end portions of said flat cables laminated one upon another, a plurality of termination grooves for receiving each conductor of said flat cable on either side, and a pluraliry of recesses for receiving said press-fit protions projecting from said housing, said cable retainer adapted to join to said insulating housing to complete said multi-layer flat cable electrical connector.

2. A multi-layer flat cable electrical connector according to claim 1, wherein said cable retainer consists of a pair of retainer sections to be joined together to form said retention channel for holding said laminated flat cables therein.

3. A multi-layer flat cable electrical connector according to claim 1, wherein said cable retainer is provided with at least two termination members one upon another to form at least two levels of parallel termination grooves.

4. A multi-layer flat cable electrical connector according to claim 1, wherein said insulating housing has at least two pairs of rows of press-fit portions and the number of said termination members is equal to (the number of said pairs of rows of press-fit portions - 1).

5. A method of terminating flat cables in a plurality of layers to a multi-layer flat cable electrical connector of the type having a plurality of contacts each having a press-fit portion for connection with a conductor of said flat cable; an insulating housing for supporting said contacts so that said press-fit portions may project upward from its top surface in at least a pair of rows; a cable retainer with a retention channel for holding the end portions of said flat cables laminated one upon another, and a plurality of termination grooves for receiving each conductor of said flat cable on either side, which comprises the steps of:

placing said end portions of said flat cables one upon another in said retention channel;

separately holding said end portions to opposite sides in said conrresponding termination grooves; and joining said insulating housing with said plurality of contacts to said cable retainer with said end portions kept on said termination grooves so that said respective end portions may be press-fitted into said corresponding press-fit portions.

6. A method according to claim 5, wherein said cable retainer consists of a pair of retainer sections and said placing step is carried out by placing said flat cables one upon another between said retainer sections.

7. A method according to claim 5, wherein said cable retainer is provided with at least two termination members and said separately holding step is carried out by placing said termination members one upon another on the bottom of said cable retainer.

* * * * *